United States Patent [19]

Baxter

[11] 4,076,635

[45] Feb. 28, 1978

[54] LUBRICANTS AND THEIR METHOD OF PREPARATION

[75] Inventor: Bryan Henry Baxter, Stevenage, England

[73] Assignee: British Aircraft Corporation Limited, London, England

[21] Appl. No.: 713,185

[22] Filed: Aug. 10, 1976

[30] Foreign Application Priority Data

Aug. 16, 1975 United Kingdom ..... 34181/75

[51] Int. Cl.[2] ..... C10M 3/18; C10M 5/14; C10M 7/20; C10M 7/24

[52] U.S. Cl. ..... 252/18; 252/25

[58] Field of Search ..... 252/18, 25

[56] References Cited

U.S. PATENT DOCUMENTS

| | | | |
|---|---|---|---|
| 2,251,093 | 7/1941 | Williams | 252/18 |
| 2,287,270 | 6/1942 | Partridge | 252/18 |

*Primary Examiner*—Delbert E. Gantz
*Assistant Examiner*—Irving Vaughn
*Attorney, Agent, or Firm*—Cushman, Darby & Cushman

[57] ABSTRACT

A lubricant, and a method for its preparation, essentially comprising colloidal particles of a metal oxide hydrate over the surface of which has been reacted fatty acid molecules having long Carbon chains. The metal used to form the metal oxide hydrate is chosen from the first transition period of the periodic table, and is preferably either Chromium, Manganese, Iron, or Cobalt. The fatty acid preferably has a Carbon chain length in the region of 16 to 24 inclusive and is present in an amount not greater than 20% by weight of the metal oxide hydrate.

11 Claims, No Drawings

LUBRICANTS AND THEIR METHOD OF PREPARATION

This invention relates to lubricants for reducing wear of the bearing surfaces of relatively movable members.

The lubricant to which this invention relates is particularly, though not exclusively, of use in gas bearing gyroscopes. In a gas bearing gyroscope the gyroscope rotor is supported by means of a gas bearing. These bearings are usually of the type wherein the rotation of the various bearing components generates the required gas pressure to maintain a working clearance between the bearing surfaces. At low rotational speeds therefore the gas pressure is insufficient to maintain the working clearance and rubbing contact occurs between the bearing surfaces.

Hitherto at least one of the bearing surfaces has been coated with a known lubricant film in order to reduce wear during rubbing. It has been found that after a number of stops and starts of the gyroscope the known lubricant film breaks down and allows rubbing contact with resulting removal of material from the contacting areas of the bearing which accumulates and leads to its evenutal seizure.

An object of the invention is to provide a more durable lubricant, and a method of preparation, which may be employed in a gas bearing.

According to the invention a lubricant includes a colloidal form of a metal oxide hydrate, the metal being chosen from those elements in the first transition period of the periodic table, and a fatty acid having a chain length in the region of 16 to 24 inclusive carbon molecules, the fatty acid being combined with surface regions of the colloidal particles of the metal oxide hydrate.

Preferably the said lubricant is prepared by forming a suspension, comprising a quantity of a colloidal form of the metal oxide hydrate and a suspending medium, adding to the suspension the fatty acid in a proportion of not more than 20% by weight of the mass of suspended colloid, dispersing the fatty acid with respect to the colloidal particles in suspension such that the fatty acid combines with a surface region of the colloidal particles to form a lubricant layer on said particles, and subsequently removing the suspending medium.

The invention will be better understood from the following description of the composition of a lubricant, the preferred method of preparing the lubricant and examples of its use.

The basic component of a lubricant according to the invention is a colloidal form of a metal oxide hydrate compound of an element chosen from the group of elements comprising the first transition period of the periodic table, i.e. Chromium, Manganese, Iron, and Cobalt. In the example being described the chosen element is Iron and the colloid is therefore Iron III oxide hydrate. In its colloidal form such a compound forms particles comprising a large number of molecules.

The Iron atoms may carry an ionic charge of up to +3, i.e. $Fe^{3+}$ions, and during the formation of the oxide hydrate these positive ionic charges are not completely cancelled. The fatty acid added to form the lubricant comprises a basic acid ring molecule which has an attached Carbon chain, the basic acid molecule having a single unbalanced negative ionic charge. The fatty acid molecules react with the metal oxide hydrate molecules to form an ionic bond balancing the opposite ion charges. Sufficient, but not excess, fatty acid is added to restrict the reaction of those metal oxide hydrate molecules on the surface of colloidal particles, thus forming a substantially stable surface layer surrounding an inner core of unreacted metal oxide hydrate molecules. The carbon chains of fatty acid molecules remain unadsorbed and outside the surface of the particles.

The fatty acid component of the lubricant, preferably has a chain length in the region of Carbon 16 to 24 inclusive, in the present example it is stearic acid having a chain length of 18 Carbon molecules. The possible range of Carbon chain lengths is much greater, but it has been found that shorter Carbon chains, i.e. much less than 16, do not produce the desired lubricating properties, whilst longer chains tend to be unstable. It has also been found that a proportion by weight of fatty acid to metal oxide hydrate of progressively greater than approximately 20% causes the colloidal particles of the metal oxide hydrate to break up into progressively smaller particles with a concomitant loss of lubricant properties.

The preferred method of preparing the lubricant is as follows:

The Iron III oxide hydrate is precipitated from an aqueous solution of Iron $^{3+}$ions, by the addition of a suitable alkali precipitant, in this example Ferric Chloride, whilst the pH value of the solution is maintained within the range 6.0 to 8.0.

The precipitated solid product is then washed in water until free from chloride ions, or other anions.

The precipitant is then transferred to a non-aqueous medium by washing with a suitable organic solvent such as acetone until free of water followed by further washing with a volatile hydrocarbon, such as heptane, until free of acetone.

The Iron III oxide hydrate is dispersed in the heptane at this stage and can be stored in this form as a suspension if necessary.

The metal oxide hydrate content of the suspension is subsequently determined by analysis so that the required quantity of fatty acid, up to 20% by weight as previously mentioned, can be added to the suspension. The resulting mixture is dispersed to a stable colloidal suspension by use of high frequency vibrations.

Finally the stability of the final product, i.e. the dispersed lubricant, is established by analysis of the infrared spectrum of the dispersion.

The lubricant is applied to the surfaces to be lubricated in the heptane dispersed form or it may be further diluted by a halogenated solvent such as chloroform. In either case the solvents are allowed to evaporate depositing a lubricant residue on the surfaces.

The lubricant is useful in a gas bearing gyroscope in which the gyroscope rotor is supported by means of a gas bearing on a steel shaft. At normal rotor speeds sufficient gas pressure is produced between the bearing surfaces, i.e. between the inner surface of the rotor and the steel shaft, to support the rotor. At lower speeds the pressure is correspondingly lower and at very low speeds the bearing surfaces are in rubbing contact resulting in wear of these surfaces. To reduce this wear hitherto at least one of the surfaces is normally coated with a known lubricant film, but after a number of stops and starts the film is found to break down and allow material to be rubbed from the bearing surfaces, this material accumulating and leading to eventual seizure of the bearing.

To overcome this problem described the lubricant is applied in small quantities on both bearing surfaces where it is held within irregularities on the bearing surfaces to form reservoirs of lubricant. When the gyroscope is started and run down the bearing surfaces rub against each other removing the small amount of material from the surfaces which contains a quantity of the lubricant. The lubricant thus removed forms thin layers of easily sheared lamellae in the areas of contact between the bearing surfaces thus acting as a lubricating film.

The irregularities in the bearing surfaces in which the reservoirs of lubricant are formed may be produced artificially by abrasion, or even by grinding or sintering during manufacture. Alternatively the naturally occurring irregularities in any surface may be employed. The lubricant is introduced in these irregularities by polishing the bearing surfaces using the lubricant as a polishing compound.

Another example of an application of the lubricant is in the lubrication of a ball or roller bearing. The lubricant is introduced to the bearing during or after assembly, merely by spreading it over the ball or roller surfaces. Then when the bearing is first turned the lubricant is spread roughly evenly over the bearing contact surfaces and the easily sheared lubricating lamellae referred to earlier are formed.

It will be appreciated that the lubricant has other possible applications, it is for example, envisaged that it may be used as a replacement for, or supplement to the normal solid lubricant such as graphite in air compressor cylinders.

I claim:

1. A lubricant comprising a colloidal form of a metal oxide hydrate, said metal selected from the group consisting of the elements in the first transition period of the periodic table such that the molecules in the colloid have uncancelled positive ionic charges, and a fatty acid selected such that each molecule has a negative ionic charge and a chain length of about 16 to 24 carbon molecules;

wherein said fatty acid molecules are combined with said metal oxide hydrate molecules on the surface of the colloidal particles thereby balancing the ionic charges thereof and forming a stable surface layer on the colloidal particles.

2. A lubricant according to claim 1 wherein the chosen metal is one of the series Chromium, Manganese, Iron and Cobalt.

3. A lubricant according to claim 1 wherein the fatty acid is stearic acid having a chain length of 18 Carbon molecules.

4. A lubricant according to claim 1 wherein the proportion of fatty acid is no greater than 20% by weight of the metal oxide hydrate.

5. A method of preparing the lubricant of claim 1 including the steps of forming a suspension of colloidal particles of metal oxide hydrate in a suspending medium, adding the fatty acid to the suspension in a proporation not substantially greater than 20% by weight of the metal oxide hydrate, dispersing the fatty acid such that it combines with a surface region of the colloidal particles, and removing the suspending medium.

6. A method according to claim 5 wherein the chose metal is iron and the suspension is formed by precipitating the hydrate from an aqueous solution of iron ions by the addition of an alkali precipitant.

7. A method according to claim 6 wherein the precipitant is ferric chloride.

8. A method according to claim 7 wherein the precipitate is washed with water to remove any chloride ions and subsequently washed with at least one organic solvent to remove water.

9. A method according to claim 8 wherein a first organic solvent is acetone and a second organic solvent is heptane.

10. A method according to claim 5 wherein dispersal of the fatty acid is effected by high frequency vibration.

11. A durable, colloidal metal oxide hydrate bearing surface lubricant characterized by fatty acid molecules combined with said metal oxide hydrate on the surface of said colloidal particles to balance the ionic charges thereof to form a stable surface layer on said colloidal particles, including: (a) a metal oxide wherein said metal is selected from the group consisting of chromium, magnesium, iron and cobalt, provided that the molecules in the colloid have uncancelled positive ionic charges, and (b) up to 20% by weight of the metal oxide hydrate of a fatty acid having a carbon atom chain length of about 16 to 24 such that each fatty acid molecule has a negative ionic charge thereon.

* * * * *